US009145894B2

(12) United States Patent
Hoshi et al.

(10) Patent No.: US 9,145,894 B2
(45) Date of Patent: Sep. 29, 2015

(54) MAGNETIC COUPLING PUMP AND PUMP UNIT COMPRISING THE SAME

(75) Inventors: Hideo Hoshi, Tokyo (JP); Syogo Nakashima, Tokyo (JP); Yasuharu Yamamoto, Tokyo (JP); Youko Yamamoto, legal representative, Kako-gun (JP); Takeshi Okubo, Tokyo (JP); Tatsuya Hidaka, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 13/822,134

(22) PCT Filed: Sep. 13, 2012

(86) PCT No.: PCT/JP2012/073460

§ 371 (c)(1), (2), (4) Date: Oct. 9, 2013

(87) PCT Pub. No.: WO2013/039144

PCT Pub. Date: Mar. 21, 2013

(65) Prior Publication Data

US 2014/0186203 A1 Jul. 3, 2014

(30) Foreign Application Priority Data

Sep. 15, 2011 (JP) ..... 2011-201850

(51) Int. Cl.

*F04D 13/02* (2006.01)
*F04D 13/06* (2006.01)
*F04D 29/58* (2006.01)

(52) U.S. Cl.

CPC ..... *F04D 13/024* (2013.01); *F04D 13/026* (2013.01); *F04D 13/0633* (2013.01); *F04D 29/588* (2013.01)

(58) Field of Classification Search

CPC ... F04D 13/024; F04D 13/025; F04D 13/026; F04D 7/04; F04D 13/0633; F04D 25/026
USPC ..... 417/420; 600/16
See application file for complete search history.

(56) References Cited

U.S. PATENT DOCUMENTS 2,810,349 A * 10/1957 Zozulin ..... 417/420
3,238,878 A * 3/1966 Martin ..... 417/370

(Continued)

FOREIGN PATENT DOCUMENTS

CN 2128317 3/1993
DE 20 2006 005 189 9/2007

(Continued)

OTHER PUBLICATIONS

International Search Report issued Dec. 11, 2012 in International (PCT) Application No. PCT/JP2012/073460 with English translation.

(Continued)

*Primary Examiner* — Alexander Comley
(74) *Attorney, Agent, or Firm* — Wenderoth, Lind & Ponack, L.L.P.

(57) ABSTRACT

In a magnetic coupling pump including a closed impeller, and a casing that houses the impeller in such a way that the impeller is rotatable around a rotation axis and movable in an axis direction in which the rotation axis extends, reduction in the rotational frequency of the impeller can be suppressed even if thrust balance collapses temporarily and the impeller and the casing come into contact with each other. A tapered surface (24) or (55) is formed in at least a portion of at least one of a surface (24) or (53) of the impeller (10) and a surface (66) or (86) of a pump casing (60) that faces each other in an axis direction (Da) so that the distance between both the faces varies gradually as it goes in a radial direction (Dr) perpendicular to the axis direction (Da).

12 Claims, 8 Drawing Sheets

(56) References Cited

U.S. PATENT DOCUMENTS

| | | | | | |
|---|---|---|---|---|---|
| 3,647,314 | A | * | 3/1972 | Laessig | 415/206 |
| 3,877,844 | A | | 4/1975 | Klaus et al. | |
| 4,120,618 | A | * | 10/1978 | Klaus | 417/420 |
| 4,613,289 | A | | 9/1986 | Kotera | |
| 4,752,194 | A | * | 6/1988 | Wienen et al. | 417/420 |
| 4,836,147 | A | * | 6/1989 | Morris | 123/41.44 |
| 4,998,863 | A | * | 3/1991 | Klaus | 417/63 |
| 5,017,102 | A | * | 5/1991 | Shimaguchi et al. | 417/420 |
| 5,090,944 | A | * | 2/1992 | Kyo et al. | 464/29 |
| 5,163,812 | A | * | 11/1992 | Klaus | 415/171.1 |
| 5,184,945 | A | | 2/1993 | Chi-Wei | |
| 5,947,703 | A | | 9/1999 | Nojiri et al. | |
| 6,908,291 | B2 | * | 6/2005 | Klein et al. | 417/420 |
| 7,057,320 | B2 | * | 6/2006 | Abordi et al. | 310/103 |
| 2010/0280305 | A1 | | 11/2010 | Hidaka et al. | |

FOREIGN PATENT DOCUMENTS

| | | | |
|---|---|---|---|
| EP | 0 431 332 | | 6/1991 |
| EP | 0 631 366 | | 12/1994 |
| EP | 1 207 308 | | 5/2002 |
| JP | 53-32881 | | 9/1978 |
| JP | 05-195989 | | 8/1993 |
| JP | 10-231797 | | 9/1998 |
| JP | 2995175 | | 12/1999 |
| JP | 3730304 | | 1/2006 |
| JP | 3942354 | | 7/2007 |
| JP | 2009-197736 | | 9/2009 |
| JP | 2009197736 | A * | 9/2009 |
| JP | 4517076 | | 8/2010 |
| JP | 4681625 | | 5/2011 |

OTHER PUBLICATIONS

Written Opinion of the International Searching Authority issued Dec. 11, 2012 in International (PCT) Application No. PCT/JP2012/073460 with English translation.

Chinese Office Action issued Oct. 15, 2013 in corresponding Chinese Patent Application No. 201280002393.9 with partial English translation.

Extended European Search Report issued Jun. 20, 2014 in corresponding European Patent Application No. 12829170.5.

* cited by examiner

MAGNETIC COUPLING PUMP AND PUMP UNIT COMPRISING THE SAME

TECHNICAL FIELD

The present invention relates to a magnetic coupling pump in which a closed impeller provided with driven magnets is rotated within a casing by the rotation of driving magnets arranged outside the casing, and a pump unit equipped therewith.

Priority is claimed on Japanese Patent Application No. 2011-201850, filed Sep. 15, 2011, the content of which is incorporated herein by reference.

BACKGROUND ART

As magnetic coupling pumps, for example, there is one disclosed in the following PTL 1.

This magnetic coupling pump is equipped with a closed impeller, and a casing that houses the impeller in such a way that the impeller is rotatable around a rotation axis and movable in an axis direction. The impeller has a columnar shaft portion centered on the rotation axis, and driven magnets formed from permanent magnets are provided within this shaft portion. The impeller are rotated integrally with the internal driven magnets by the rotation of driving magnets that are arranged outside the casing so as to face the driven magnets and are magnetically coupled with the driven magnets.

A portion of an inner casing surface forms an inner peripheral surface that is formed in a cylindrical shape around the rotation axis, and a portion of an outer impeller surface forms an outer peripheral surface that faces the inner peripheral casing surface and is formed in a cylindrical shape around the rotation axis. A gap is presents between the inner peripheral casing surface and the outer peripheral impeller surface, and the respective peripheral surfaces form dynamic pressure bearing faces.

Additionally, another portion of the inner casing surface forms a perpendicular inner surface that widens in a radial direction perpendicular to the rotation axis, and another portion of the outer impeller surface forms a perpendicular outer surface that faces the perpendicular inner casing surface in parallel at a distance therefrom in the axis direction.

That is, in this magnetic coupling pump, the impeller rotates within the casing where the inner casing surface and the outer impeller surface are in a state of non-contact.

CITATION LIST

Patent Literature

[PTL 1] Japanese Unexamined Patent Application, First Publication No. 2009-197736

SUMMARY OF INVENTION

Technical Problem

In the magnetic coupling pump described in the above PTL 1, a more than expected thrust force may be applied to the impeller due to impact, operation varies, or the like from the outside, thrust balance may collapse, and the outer impeller surface and the inner casing surface that face each other in the axis direction may come into contact with each other. In such a case, in the magnetic coupling pump, the suction force of the contact portion will be generated by a negative pressure applied between both the faces that has contacted, and both the faces will continue contacting over a relatively long period of time. For this reason, in the magnetic coupling pump, there is a problem in that the rotational frequency of the impeller may be reduced over a relatively long period of time due to the contact between the impeller and the casing.

Thus, an object of the invention is to provide a magnetic coupling pump that can suppress reduction in the rotational frequency of an impeller even if thrust balance collapses temporarily, and a pump unit equipped therewith.

Solution to Problem

A magnetic coupling pump related to the invention for solving the above problems is a magnetic coupling pump including: a closed impeller; and a casing that houses the impeller in such a way that the impeller is rotatable around a rotation axis and movable in an axis direction in which the rotation axis extends, wherein the impeller comprises a columnar shaft portion centered on the rotation axis, a driven magnet formed from a permanent magnet is provided within the shaft portion, the impeller is rotated integrally with the driven magnet by rotation of a driving magnet around the rotation axis, the driving magnet being provided outside of the casing and arranged on the outer peripheral side of the shaft portion so as to face the driven magnet and to be magnetically coupled with the driven magnet, and a tapered surface is formed in a part of at least one of an impeller surface and a casing surface facing each other in the axis direction in such a way that a distance between the impeller surface and the casing surface is gradually varied in a radial direction perpendicular to the axis direction.

In the magnetic coupling pump, even if a thrust force that is a more than expected force in the axis direction is applied to the impeller due to impact, operation varies, or the like from the outside, thrust balance collapses, and a portion of the impeller and a portion of the pump casing that face each other in the axis direction come into contact with each other, a region where face contact is made can be made small, or line contact is made and consequently a region where face contact is made can be eliminated. In addition, a negative pressure applied to between the faces that have contacted can be made small. For this reason, in the magnetic coupling pump, even if the impeller and the casing come into contact with each other, contact time can be shortened, and reduction in the rotational frequency of the impeller caused by the contact can be suppressed to the minimum. In addition, any damage in a contact portion between the casing and the impeller can be suppressed to the minimum. Moreover, seizing in the contact portion between the casing and the impeller can be prevented.

Additionally, in the magnetic coupling pump, a rotating shaft that passes through a casing becomes unnecessary because the impeller is rotated within the casing. For this reason, in the magnetic coupling pump, any damage to the grains included in the liquid in a portion where the rotating shaft passes through the casing can be prevented as well as leakage of the liquid from the inside of the casing can be eliminated.

Moreover, in the magnetic coupling pump, the shaft portion of the impeller is arranged inside the driving magnet and the driven magnet is provided within the shaft portion. Thus, the external diameter of the shaft portion of the impeller can be made smaller than that in a case where the driven magnet is arranged outside the driving magnet. Hence, according to the magnetic coupling pump, it is possible to reduce the size and weight of the impeller, and an inertia force regarding the rotation of the impeller can be made small.

Additionally, according to the magnetic coupling pump, the external diameter of the shaft portion of the impeller can be made small. Therefore, the circumferential speed of the shaft portion can be suppressed. Hence, according to the magnetic coupling pump, a shearing strain that acts on a liquid that flows between the outer peripheral surface of the shaft portion and the inner peripheral casing surface can be made small, and any damage to the grains or the like included in the liquid can be suppressed.

Here, in the magnetic coupling pump, a discharge port and a suction port may be provided to the casing, the suction port being on an extension line of the rotation axis, the impeller may includes: a plurality of blades provided in a circumferential direction around the rotation axis; a front shroud that covers a front side of the plurality of blades that is the suction port side; and a rear shroud that covers a rear side of the plurality of blades opposite to the suction port, the front shroud may include an inlet tube portion, which forms a cylindrical shape around the rotation axis and may form an impeller inlet whose front side faces the suction port in the axis direction, and a front plate portion, which is provided at a rear end of the inlet tube portion and covers the front side of the plurality of blades, the rear shroud may include a rear plate portion that covers the rear side of the plurality of blades, and the shall portion provided at a rear end of the rear plate portion, an impeller outlet may be formed at an outer edge of the impeller in the radial direction and between the front plate portion and the rear plate portion of the impeller, a front plate tapered surface may be formed on a front face of the front plate portion on the front side as the tapered surface, which inclines to the rear side gradually as it goes to an outward side away from the rotation axis, and a rear plate tapered surface may be formed on a rear face of the rear plate portion on the rear side as the tapered surface, which inclines to the front side gradually as it goes to the outward side away from the rotation axis.

In the magnetic coupling pump, even if a thrust force that is a more than expected forward force in the axis direction is applied to the impeller due to impact or the like from the outside, thrust balance collapses, and the front face of the front plate portion of the impeller, and the portion of the casing that faces in the axis direction come into contact with each other, a region where face contact is made can be made small, or line contact is made and consequently a region where face contact is made can be eliminated.

Additionally, in the magnetic coupling pump, even if a thrust force that is a more than expected rearward force in the axis direction is applied to the impeller due to impact or the like from the outside, thrust balance collapses, and the rear face of the rear plate portion of the impeller, and the portion of the casing that faces in the axis direction come into contact with each other, a region where face contact is made can be made small, or line contact is made and consequently a region where face contact is made can be eliminated.

Additionally, in the magnetic coupling pump, a front end portion of the inlet tube portion may be formed with an inlet tapered surface as the tapered surface, which inclines to the rear side as it goes to an inward side approaching the rotation axis from the outer peripheral surface side of the inlet tube portion.

In the magnetic coupling pump, even if a thrust force that is a more than expected forward force in the axis direction is applied to the impeller due to impact or the like from the outside, thrust balance collapses, and the front end portion of the inlet tube portion located on the foremost side in the impeller, and the portion of the casing that faces in the axis direction come into contact with each other, a region where face contact is made can be made small, or line contact is made and consequently a region where face contact is made can be eliminated.

Additionally, in the magnetic coupling pump, a circular-arc surface may be formed connecting to the outer peripheral surface of the inlet tube portion and the inlet tapered surface in a boundary portion between the outer peripheral surface and the inlet tapered surface, the circular-arc surface being in a circular-arc shape in which the shape of a cross-section including the rotation axis is convex toward the front side, and an arc radius of the circular-arc surface may be larger than the average radius of grains included in a liquid to be carried.

A portion of the liquid suctioned into the casing from the suction port comes into contact with the front end of the inlet tube portion located on the foremost side in the impeller. In the magnetic coupling pump, the front end of the inlet tube portion is formed with the circular-arc surface that becomes convex toward the front side. Moreover, the arc radius of this circular-arc surface is larger than the average radius of the grains included in the liquid to be carried. For this reason, in the magnetic coupling pump, any damage to the grains in the liquid can be prevented even if the liquid comes into contact with the front end of the inlet tube portion. In addition, the average radius of the grains is an average value of half of the dimension of a portion that is the longest among the dimensions of the grains.

Additionally, in the magnetic coupling pump, the minimum internal diameter among the internal diameters of the inlet tube portion may be equal to or more than the internal diameter of the suction port of the casing.

In the magnetic coupling pump, the pressure loss in the process in which the liquid flows into the impeller from the suction port of the casing can be suppressed, and pump performance can be enhanced.

Additionally, in the magnetic coupling pump, a through hole, which penetrates through the rotation axis in the axis direction and connects an interspace between a rear end face of the shaft portion on the rear side and the casing to a space between the front plate portion and the rear plate portion, may be formed in the shaft portion, and a shaft tapered surface may be formed on the rear end face of the shaft portion as the tapered surface, which inclines to the front side gradually as it goes to the inward side approaching the rotation axis.

In the magnetic coupling pump, even if a thrust force that is a more than expected rearward force in the axis direction is applied to the impeller due to impact or the like from the outside, thrust balance collapses, and the rear end face of the shaft portion of the impeller, and the portion of the casing that faces in the axis direction come into contact with each other, a region where face contact is made can be made small, or line contact is made and consequently a region where face contact is made can be eliminated.

Additionally, in the magnetic coupling pump, an inner peripheral surface, which has a cylindrical shape around the rotation axis and faces an outer peripheral surface of the shaft portion at a distance therefrom, may be formed on the casing, and the inner peripheral surface may form a dynamic pressure bearing face for the shaft portion.

In the magnetic coupling pump, the inlet tube portion of the impeller can be rotatably supported in a non-contact state by the dynamic pressure bearing casing surface.

Additionally, in the magnetic coupling pump, an inner peripheral surface, which has a cylindrical shape around the rotation axis and faces an outer peripheral surface of the inlet tube portion at a distance therefrom, may be formed on the casing, and the inner peripheral surface may form a dynamic pressure bearing face for the inlet tube portion.

In the magnetic coupling pump, the shaft portion of the impeller can be rotatably supported in a non-contact state by the dynamic pressure bearing casing surface. Moreover, in the magnetic coupling pump, two locations of the inlet tube portion and the shaft portion of the impeller are rotatably supported in a non-contact state in the radial direction by the casing, in other words, the impeller is rotatably supported at both ends in a non-contact state in the radial direction. Hence, in the magnetic coupling pump, even if moment around an axis perpendicular to the rotation axis is generated, the impeller can be stably supported.

The magnetic coupling pump unit related to the invention for solving the above problems includes: one of the above described magnetic coupling pumps, which are an aspect of the present invention; a motor having a rotating output shaft; the driving magnet fixed to the output shaft of the motor; and a drive unit casing that houses the motor and the driving magnet, and to which the magnetic coupling pump is detachably attached so that the rotation axis of the magnetic coupling pump is located on the extension line of the output shaft of the motor.

In the magnetic coupling pump unit, even in a case where this magnetic coupling pump is wasted or cleaned after the magnetic coupling pump is used, the pump drive unit used for the driving of the magnetic coupling pump can be used as a pump drive unit of other magnetic coupling pumps.

Advantageous Effects of Invention

In the present invention, even if a thrust force that is a more than expected force in the axis direction is applied to the impeller due to impact, operation varies, or the like from the outside, thrust balance collapses, and a portion of the impeller and a portion of the casing that face each other in the axis direction come into contact with each other, a region where face contact is made can be made small, or line contact is made and consequently a region where face contact is made can be eliminated. In addition, a negative pressure applied to between the faces that has contacted can be made small. For this reason, in the present invention, even if the impeller and the casing come into contact with each other, contact time can be shortened, in other words, the impeller can return to its original position in a short time.

Hence, according to the invention, even if the impeller and the casing come into contact with each other, reduction in the rotational frequency of the impeller caused by the contact can be suppressed to the minimum. In addition, any damage in a contact portion between the casing and the impeller can be suppressed to the minimum. Moreover, according to the invention, seizing in the contact portion between the casing and the impeller can be prevented.

DESCRIPTION OF EMBODIMENTS

Figure 1:
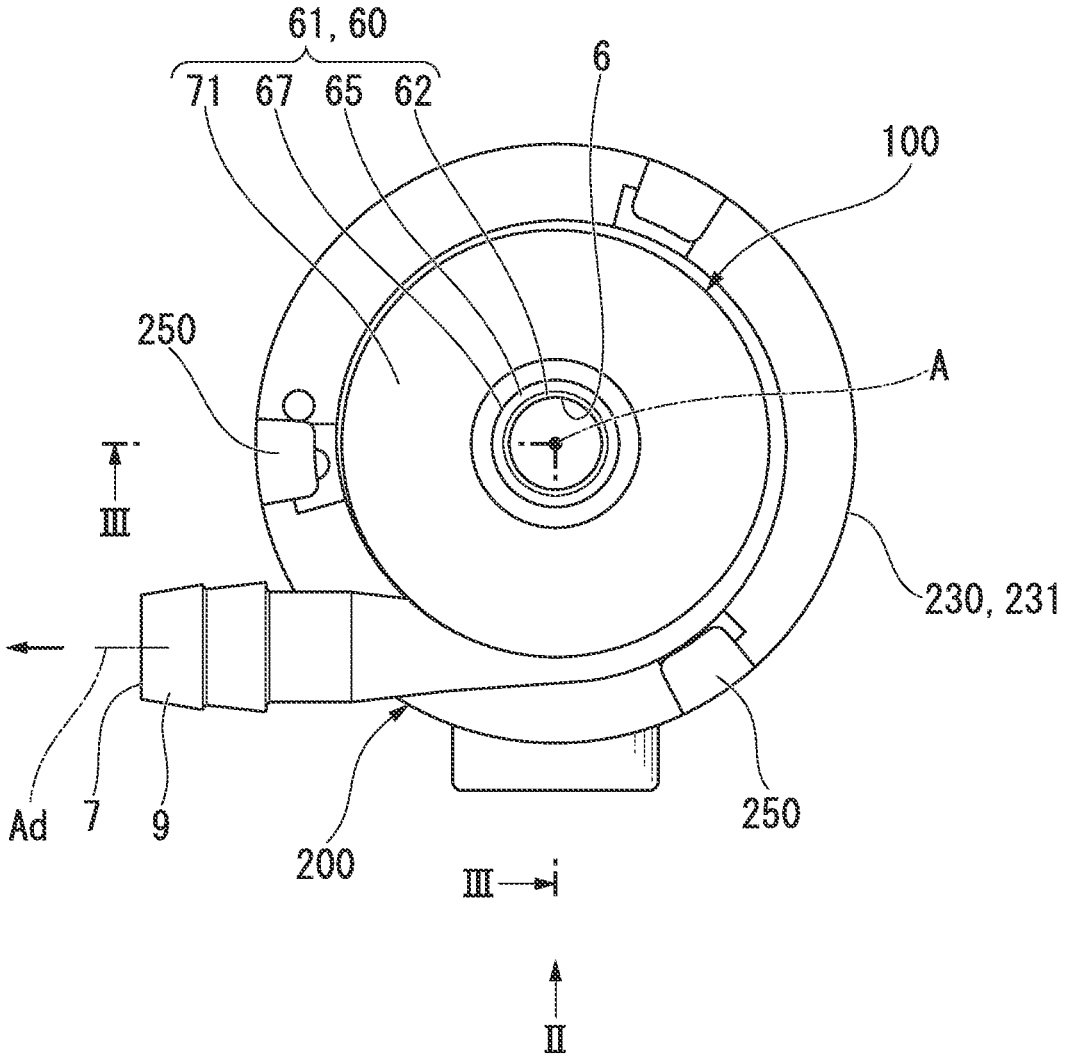
FIG. 1 is a plan view of a magnetic coupling pump unit in an embodiment related to the invention.

Hereinafter, an embodiment of a magnetic coupling pump unit related to the invention will be described in detail referring to the drawings.

Figure 2:
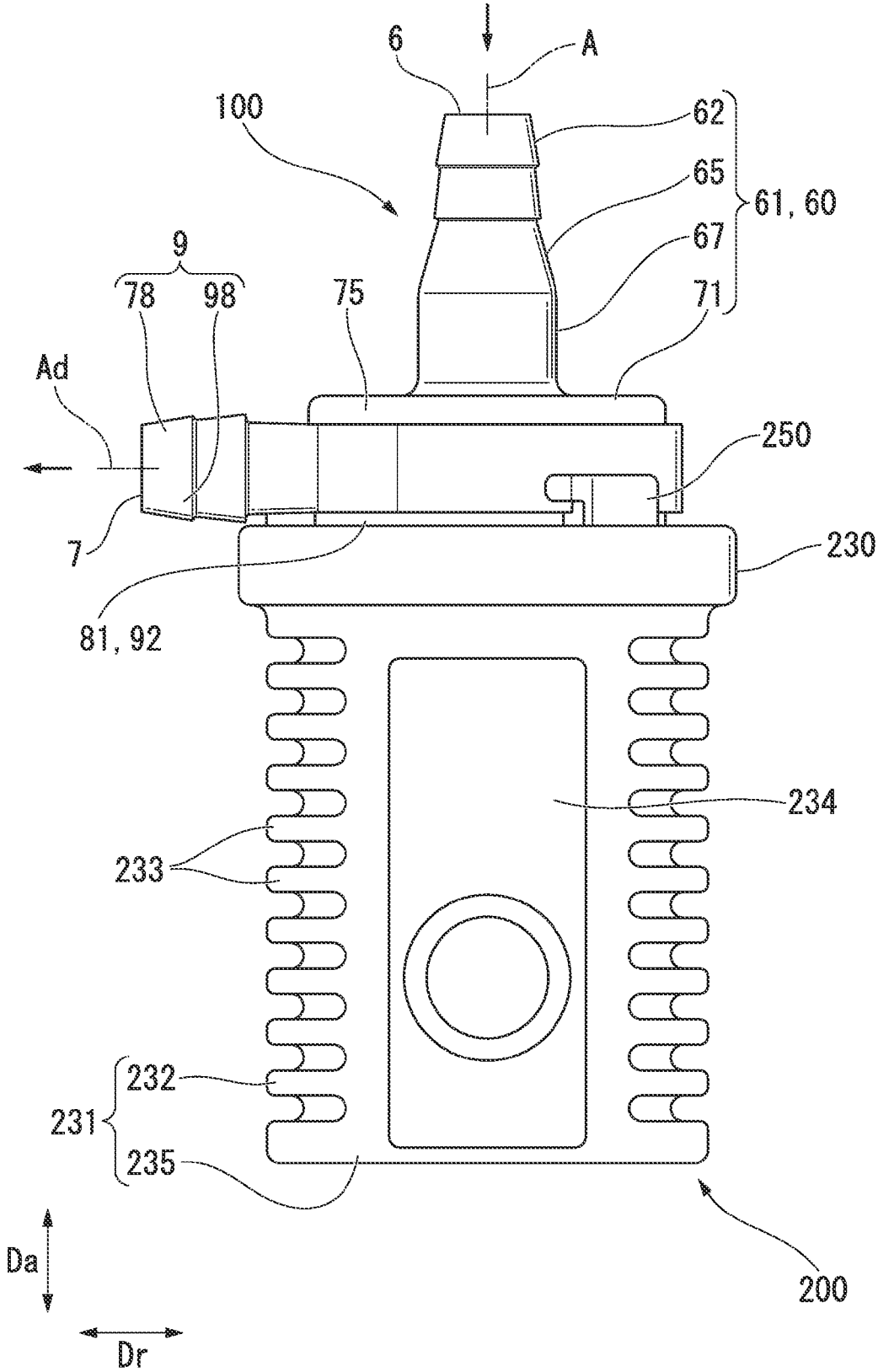
FIG. 2 is a view as seen from arrow II in FIG. 1.
Figure 3:
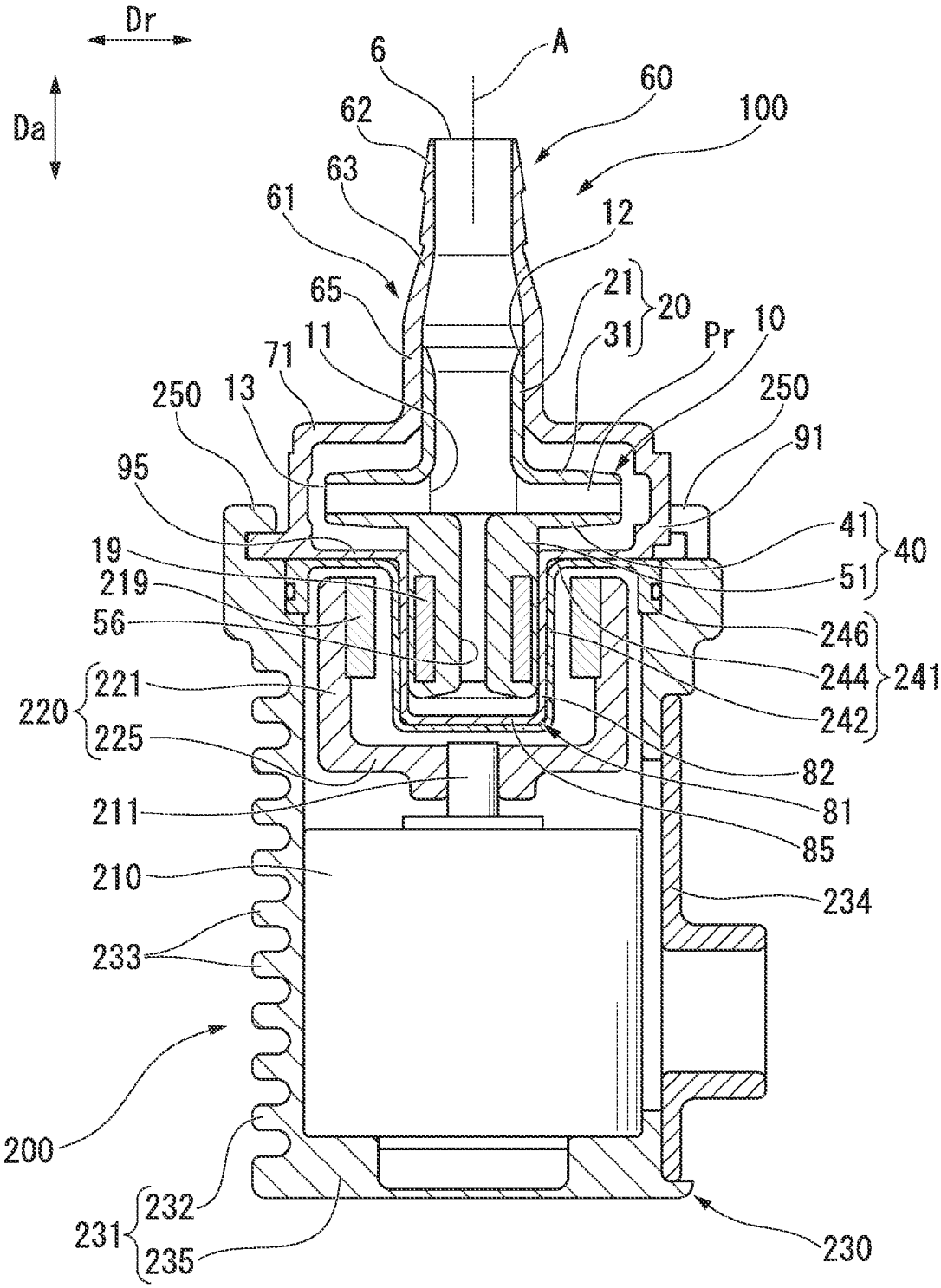
FIG. 3 is a cross-sectional view taken along line III-III in FIG. 1.

The magnetic coupling pump unit of the present embodiment, as shown in FIGS. 1 to 3, is equipped with a magnetic coupling pump 100 that carries a liquid, and a pump drive unit 200 that drives the magnetic coupling pump 100.

The magnetic coupling pump 100 is used in order to carry a liquid including jelly-like grains (for example, an average diameter of about 3 to 4 μm) or microcapsules (for example, an average radius of about 1 to 50 μm). However, the magnetic coupling pump 100 may be used in order to carry a liquid that does not include the jelly-like grains, microcapsules, or the like as described above.

Figure 4:
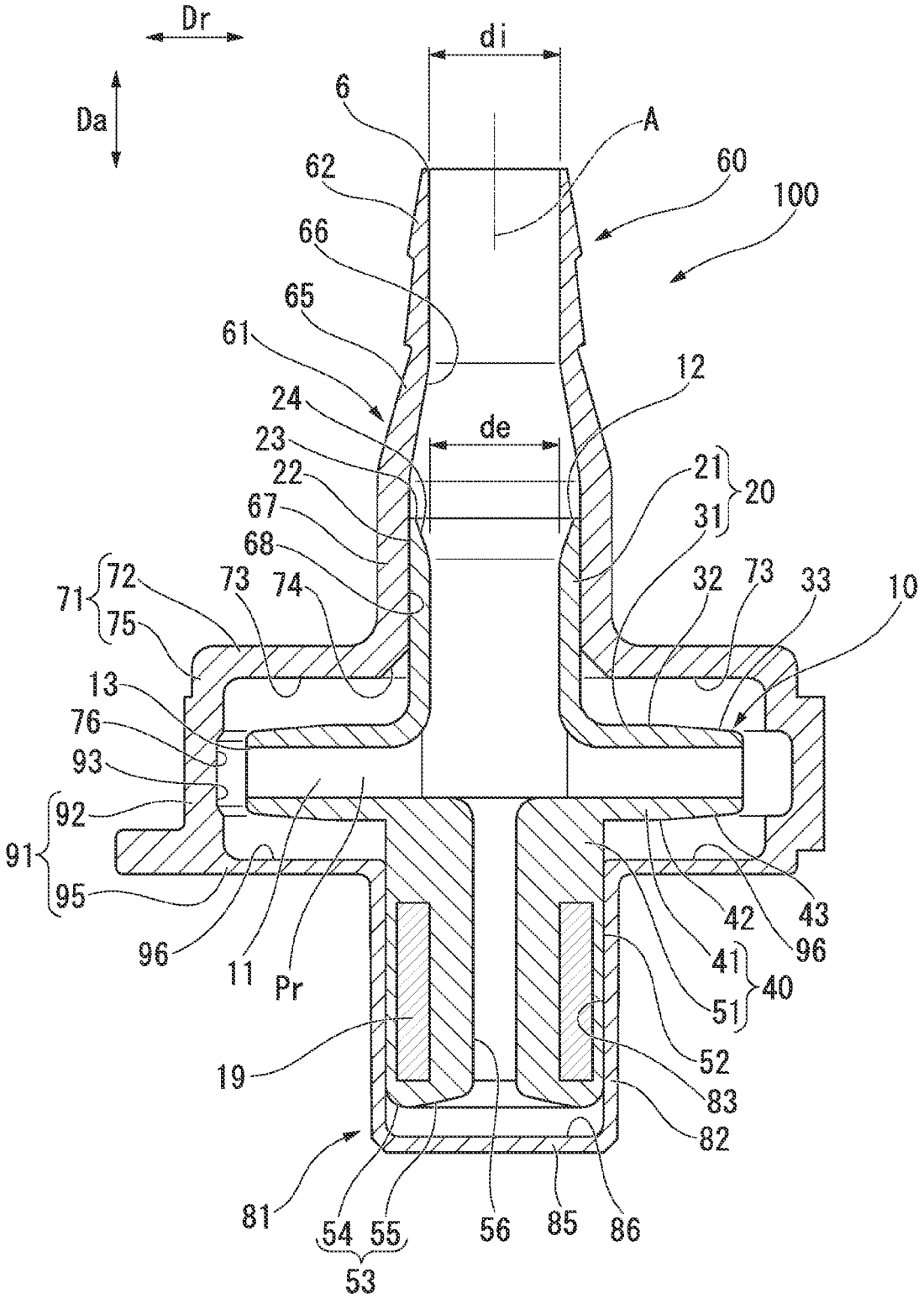
FIG. 4 is a cross-sectional view of a magnetic coupling pump in the embodiment related to the invention.

The magnetic coupling pump 100, as shown in FIG. 4, is equipped with a closed impeller 10, and a pump casing 60 that covers the impeller 10 in such a way that the impeller is rotatable around a rotation axis A.

The pump casing 60 is formed with a discharge port (refer to FIGS. 1 and 2) 7 for discharging a liquid, and a suction port 6 for suctioning a liquid on an extension line of the rotation axis A. In addition, in the following, in an axis direction Da in which the rotation axis A extends, a suction port 6 side of the pump casing 60 is defined as a front side and a side opposite to the front side is defined as a rear side. Additionally, in a radial direction Dr that is a direction perpendicular to the rotation axis A, a side approaching the rotation axis A is defined as an inward side and a side moving away from the rotation axis A is defined as an outward side.

The impeller 10 has a plurality of blades 11 provided in a circumferential direction around the rotation axis A, a front shroud 20 that covers the front side of the plurality of blades 11, and a rear shroud 40 that covers the rear side of the plurality of blades 11. As described above, the impeller 10 forms a closed impeller as the front and rear of the plurality of blades 11 are covered with the front shroud 20 and the rear shroud 40. The plurality of blades 11, the front shroud 20, and the rear shroud 40 are joined to each other.

The front shroud 20 forms a cylindrical shape around the rotation axis A, and has an inlet tube portion 21 that forms an impeller inlet 12 in which a front opening in the axis direction Da faces the suction port 6 of the pump casing 60, and a front plate portion 31 that is provided at a rear end in the inlet tube portion 21 and covers the front side of the plurality of blades 11. Additionally, the rear shroud 40 has a rear plate portion 41 that covers the rear side of the plurality of blades 11, and a shaft portion 51 that is provided at a rear end of the rear plate portion 41 and is columnar around the rotation axis A.

Both the shapes of the front plate portion 31 of the front shroud 20 and the rear plate portion 41 of the rear shroud 40 as viewed from the axis direction Da are circular around the rotation axis A. The front plate portion 31 and the rear plate portion 41 are apart from each other in the axis direction Da, and the plurality of blades 11 are fixed between the front plate portion 31 and the rear plate portion 41. An outer edge in the radial direction Dr between the front plate portion 31 and the rear plate portion 41 forms an impeller outlet 13. An intra-impeller flow channel Pr is formed between the plurality of blades 11 between the front plate portion 31 and the rear plate portion 41 within the inlet tube portion 21.

The shaft portion 51 of the rear shroud 40 is formed with a through hole 56 that passes through a rotation axis A in the axis direction Da and allows the intra-impeller flow channel Pr to communicate between a rear end face 53 of the shaft portion 51 and the pump casings 60. A plurality of driven magnets 19 formed from permanent magnets are embedded at a position between an outer peripheral surface 52 of the shaft portion and an inner peripheral surface of the through hole 56 in the shaft portion 51.

Figure 5:
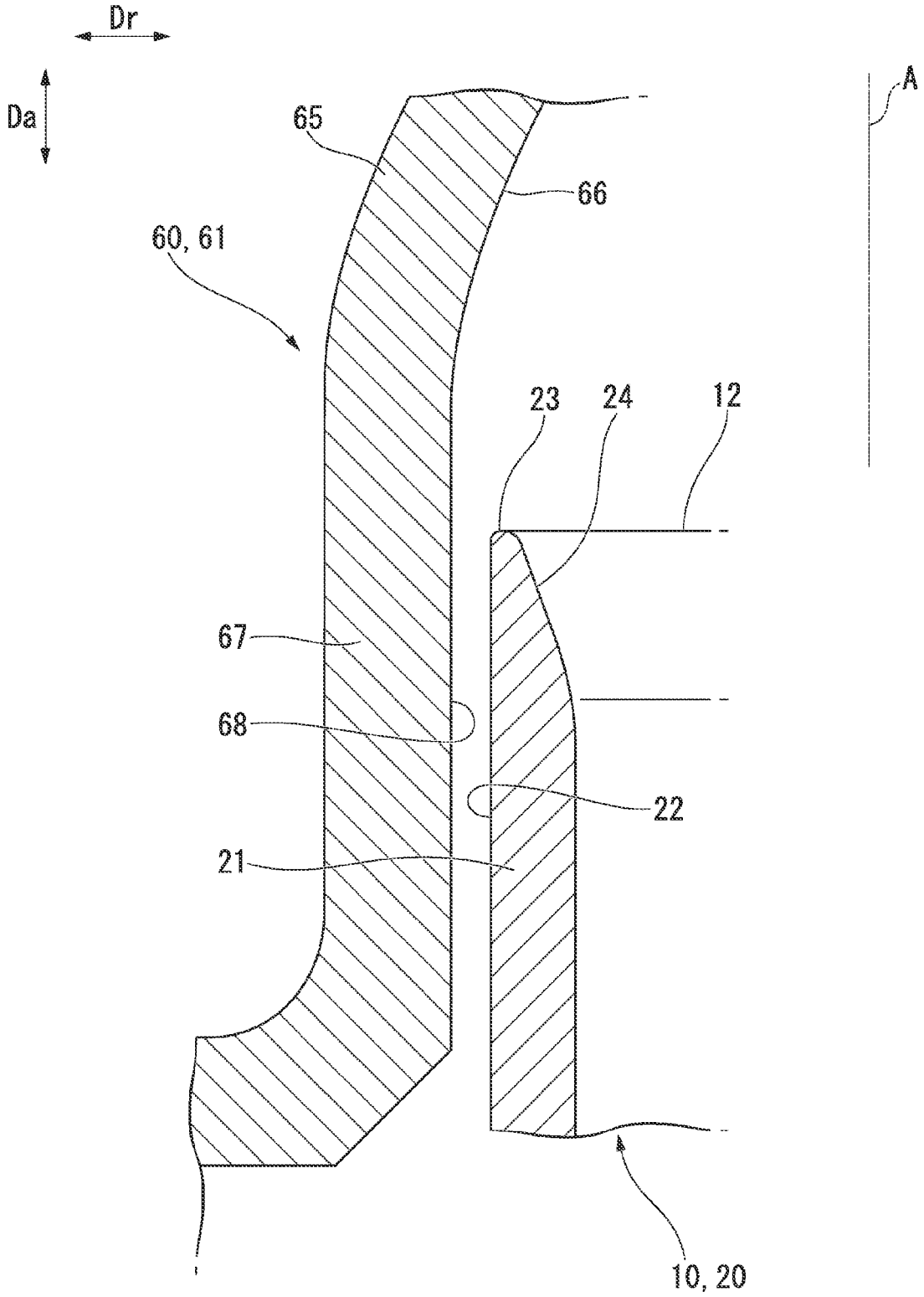
FIG. 5 is a cross-sectional view of main portions of a magnetic coupling pump in the embodiment related to the invention.

As shown in FIG. 5, an inlet tapered surface 24 that inclines to the rear side as it goes from an outer peripheral surface 22 side of the inlet tube portion 21 to the inward side is formed at a front end portion of the inlet tube portion 21 in the impeller 10.

A boundary portion between the outer peripheral surface 22 of the inlet tube portion 21 and the inlet tapered surface 24 is formed with a circular-arc surface 23 that forms a circular-arc shape in which the shape in a cross-section including the rotation axis A becomes convex toward the front side and that is continuous with the outer peripheral surface 22 and the inlet tapered surface 24. The arc radius of the circular-arc surface 23 is 0.2 to 0.3 mm larger than the average radius (3 to 4 μm) of the jelly-like grains in the liquid carried by this pump or the average radius (about 1 to 50 μm) of the microcapsules in the liquid. In addition, the average radius of the jelly-like grains or the microcapsules is an average value of half of the dimension of a portion that is the longest among the dimensions of the jelly-like grains or the microcapsules.

Figure 6:
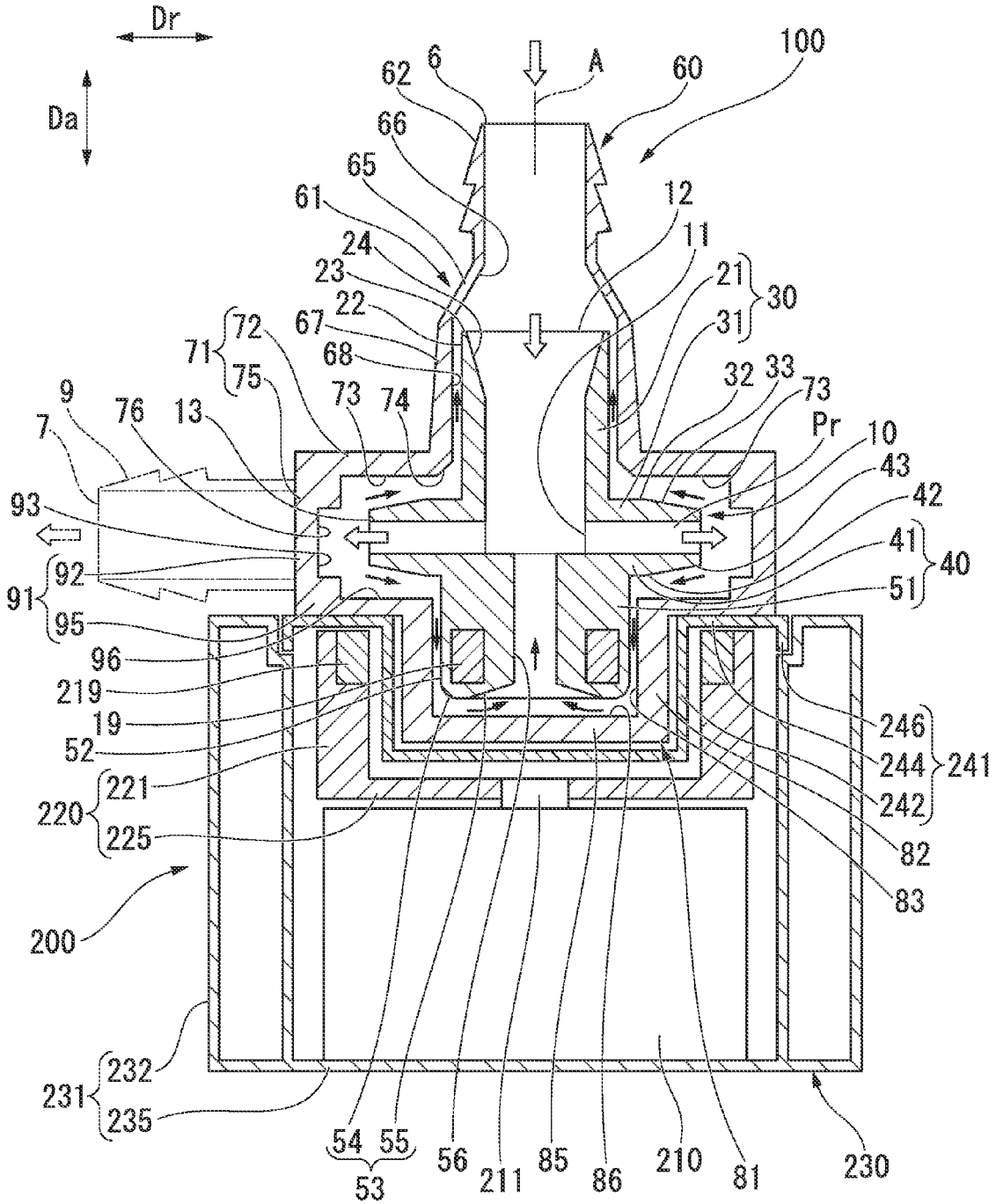
FIG. 6 is a schematic view schematically depicting the cross-section of the magnetic coupling pump unit in the embodiment related to the invention.

As shown in FIGS. 4 and 6, a front plate tapered surface 33 that inclines to the rear side gradually as it goes to the outward side is formed on the outward side of the front face 32 of the front plate portion 31 in the impeller 10. Additionally, a rear plate tapered surface 43 that inclines to the front side gradually as it goes to the outward side is formed on the outward side of the rear face 42 of the rear plate portion 41. Additionally, a shaft tapered surface 55 that inclines to the front side gradually as it goes to the inward side is formed on the inward side of the rear end face 53 of the shaft portion 51. A boundary portion between the outer peripheral surface 52 and the shaft tapered surface 55 of the shaft portion 51 is formed with a circular-arc surface 54 that forms a circular-arc shape in which the shape in a cross-section including the rotation axis A becomes convex toward the rear side and that is continuous with the outer peripheral surface 52 and the shaft tapered surface 55. The shaft tapered surface 55 is continuous with the inner peripheral surface of the through hole 56 in the shaft portion 51.

The pump casing 60 has a pump front casing 61 that covers the front shroud 20 of the impeller 10, and a pump rear casing 81 that covers the rear shroud 40 of the impeller 10.

The pump front casing 61 has a substantially cylindrical suction hose connecting pipe portion 62 to which a suction hose is connected, an enlarged-diameter pipe portion 65 of which the internal diameter is gradually enlarged from a rear end of the suction hose connecting pipe portion 62 toward the rear side, a front bearing forming portion 67 that is provided at a rear end of the enlarged-diameter pipe portion 65 and is formed with an inner peripheral surface 68 that faces the outer peripheral surface 22 of the inlet tube portion 21 of the front shroud 20 at a distance therefrom, and a front casing body portion 71 that is provided at a rear end of the front bearing forming portion 67 and covers the front plate portion 31 of the front shroud 20.

A front end of the suction hose connecting pipe portion 62 opens, and this opening forms the suction port 6 of the pump casing 60. The internal diameter di of the suction port 6 is equal to the eyeball diameter de of the impeller 10. In addition, in the present embodiment, the eyeball diameter de of an impeller 10 is the smallest internal diameter among the internal diameters of the inlet tube portion 21 of the impeller 10 of which the internal diameter varies in the axis direction Da. As such, in the present embodiment, in order to make the internal diameter di of the suction port 6 of the pump casing 60 and the eyeball diameter de of the impeller 10 the same, the enlarged-diameter pipe portion 65 is provided at a position closer to the front side than the inlet tube portion 21 of the impeller 10 in the pump casing 60 so as to make the internal diameter of the front bearing forming portion 67 of the pump casing 60 at the same position as the inlet tube portion 21 of the impeller 10 in the axis direction Da larger than the diameter di of the suction port 6.

The front casing body portion 71 has a flat-plate-ring-shaped front face facing portion 72 that widens from a rear end of the front bearing forming portion 67 to the rear end, and faces the front face 32 of the front plate portion 31 of the front shroud 20 at a distance therefrom in the axis direction Da, and a front body tube portion 75 that forms a substantially cylindrical shape around the rotation axis A and extends from the outer peripheral edge of the front face facing portion 72 to the rear side. A front case body tapered surface 74 that inclines to the front side gradually as it goes to the inward side is formed on the inward side of the inner surface 73 of the front face facing portion 72.

The shape in the cross-section of the inner peripheral surface 76 of the front body tube portion 75 perpendicular to the rotation axis A forms a volute shape. The inner peripheral surface 76 of the front body tube portion 75 faces the outer peripheral edge of the front plate portion 31 of the front shroud 20 at a distance therefrom.

The pump rear casing 81 has a rear casing body portion 91 that is provided at a rear end of the front casing body portion 71 and covers the rear plate portion 41 of the rear shroud 40, a rear bearing forming portion 82 that is formed with an inner peripheral surface 83 that is provided at a rear casing body portion 91 and faces the outer peripheral surface 52 of the shaft portion 51 of the rear shroud 40 at a distance therefrom, and a flat-plate circular rear wall plate portion 85 that is provided at a rear end of the rear bearing forming portion 82 and faces the shaft portion 51 of the rear shroud 40 at a distance therefrom in the axis direction Da.

The rear casing body portion 91 has a rear body tube portion 92 that forms a substantially cylindrical shape around the rotation axis A and extends from a rear end of the front casing body portion 71 to the rear side, and a flat-plate-ring-shaped rear face facing portion 95 that widens from a rear end of the rear body tube portion 92 to the inward side and faces the rear face 42 of the rear plate portion 41 of the rear shroud 40 at a distance therefrom in the axis direction Da. An inner edge of the rear face facing portion 95 is provided with a rear bearing forming portion 82 that extends rearward from this inner edge.

The pump casing 60, as shown in FIGS. 1 and 2, has a substantially cylindrical discharge hose connecting pipe portion 9 to which a discharge hose is connected. An axis Ad of the substantially cylindrical discharge hose connecting pipe portion 9 is parallel to a face perpendicular to the rotation axis A. Additionally, the discharge hose connecting pipe portion 9 is divided into two in a front-and-rear direction in a plane passing through the axis Ad. One discharge hose connecting pipe hose portion is provided at the front body tube portion 75 of the pump front casing 61 as a connecting pipe front divided portion 78, and the other discharge hose connecting pipe hose portion is provided at the rear body tube portion 92 of the pump rear casing 81 as a connecting pipe rear divided portion 98. An outer end of the discharge hose connecting pipe portion 9 opens, and this opening forms the discharge port 7 of the pump casing 60.

The pump front casing 61 and the pump rear casing 81 are integrally molded products made of resin, respectively. The pump front casing 61 and the pump rear casing 81 are joined together with an adhesive.

The pump drive unit 200, as shown in FIGS. 3 and 6, is equipped with a motor 210 having a rotating output shaft 211, a cup 220 that forms a bottomed cylindrical shape, a plurality of driving magnets 219 that are fixed to the inner peripheral side of the cup 220, a drive unit casing 230 that covers the motor 210 and the cup 220, and a lock member 250 for maintaining mounting of the magnetic coupling pump 100 mounted on the drive unit casing 230.

The cup 220 is formed from, for example, carbon steel, such as SS400, which is a ferromagnetic material, and serves as a yoke of the plurality of driving magnets 219. The cup 220 has a cylindrical cup cylinder portion 221, and a flat-plate circular motor connection 225 that blocks one opening of the cup cylinder portion 221. The output shaft 211 of the motor 210 is fixed onto an extension line of the axis of the cup cylinder portion 221 on the motor connection 225. As mentioned above, the plurality of driving magnets 219 are fixed to the inner peripheral side of the cup cylinder portion 221. The driving magnets 219 are permanent magnets, for example, Nd (neodymium) magnets.

The internal diameter of the cup cylinder portion 221 is larger than the external diameter of the rear bearing forming portion 82 of the pump rear casing 81. Additionally, a length (hereinafter referred to as magnet array diameter) twice the radial length from the axis of the cup cylinder portion 221 to the inner surface of each driving magnet 219 is larger than the external diameter of the rear bearing forming portion 82 of the pump rear casing 81.

The drive unit casing 230 has a bottomed cylindrical casing body 231, and a cap 241 that blocks an opening of the casing body 231.

The casing body 231 is formed from, for example, an Al (aluminum) alloy that is a paramagnetic material. The casing body 231 has a cylindrical casing cylinder portion 232 that has a larger internal diameter than the external diameter of the cup 220 and the external diameter of the motor 210, and a flat-plate circular casing bottom portion 235 that blocks one opening of the casing cylinder portion 232.

The motor 210 is put into the casing body 231, and is fixed to the casing bottom portion 235 with screws or the like. A portion of an outer periphery of the casing cylinder portion 232 forms a concavo-convex shape in the radial direction Dr, and convex portions form radiation fins 233. Additionally, a power cable plate 234 for allowing a power cable of the motor 210 to pass therethrough is constructed in another portion of the casing cylinder portions 232.

The cap 241 is formed from, for example, resin, such as engineering plastic. The cap 241 has a pump fitting portion 242 that forms a bottomed cylindrical shape and into which the rear bearing forming portion 82 and the rear wall plate portion 85 of the pump rear casing 81 fit, a pump receiving portion 244 that widens from an opening edge of the bottomed cylindrical pump fitting portion 242 to the outward side and forms a flat-plate ring shape, and an engaging portion 246 that is formed at an outer peripheral edge of the pump receiving portion 244 and engages an opening edge of the casing body 231.

The internal diameter of the bottomed cylindrical pump fitting portion 242 is substantially equal to the external diameter of the rear bearing forming portion 82 of the pump casing 60. Hence, the rear bearing forming portion 82 of the pump casing 60 can be fitted into the pump fitting portion 242 of the cap 241. Additionally, the pump fitting portion 242 has a smaller external diameter than the internal diameter of the cup cylinder portion 221 and the aforementioned magnet array diameter, and enters the cylindrical bottomed cup 220 in a non-contact state with the driving magnets 219 fixed to the cup 220.

Next, the operation of the magnetic coupling pump unit described above will be described.

When the magnetic coupling pump unit is used, first, the suction hose is connected to the suction hose connecting pipe portion 62 of the magnetic coupling pump 100, and the discharge hose is connected to the discharge hose connecting pipe portion 9.

Next, the rear bearing forming portion 82 of the pump casing 60 is fitted into the pump fitting portion 242 of the cap 241 of the drive unit casing 230, and the magnetic coupling pump 100 is attached to the pump drive unit 200. In this case, the rear face facing portion 95 of the pump casing 60 and the pump receiving portion 244 of the cap 241 come into contact with each other. Next, the pump casing 60 is fixed to the drive unit casing 230 by the lock member 250.

In the magnetic coupling pump unit, in this state, the driven magnets 19 embedded in the shaft portion 51 of the magnetic coupling pump 100 and the driving magnets 219 fixed to the cup 220 of the pump drive unit 200 face each other in the radial direction Dr, and both the magnets are magnetically coupled to each other. Additionally, the output shaft 211 of the motor 210 is located on the extension line of the rotation axis A of the dynamic pressure bearing pump 100.

In addition, in the above, the magnetic coupling pump 100 is attached to the pump drive unit 200 after the connection of the suction hose and the discharge hose, the connection of the suction hose and the discharge hose may be performed after the attachment of the magnetic coupling pump 100.

Next, electric power is supplied to the motor 210 of the pump drive unit 200 so as to rotate the output shaft 211 of the motor 210 and rotate the cup 220 fixed to the output shaft 211 and the plurality of driving magnets 219 fixed to the cup 220. If the driving magnets 219 of the pump drive unit 200 rotate, the driven magnets 19 of the magnetic coupling pump 100 that are magnetically coupled to the driving magnets 219 also rotates around the rotation axis A with the rotation of the driving magnets 219. The driven magnets 19 of the magnetic coupling pump 100 are embedded in the shaft portion 51 of the impeller 10. For this reason, if the driving magnets 219 of the pump drive unit 200 rotate, the impeller 10 rotates around the rotation axis A within the pump casing 60 together with the driven magnets 19.

As described above, in the present embodiment, the shaft portion 51 of the impeller 10 is arranged inside the plurality of driving magnets 219 and the driven magnets 19 are embedded within the shaft portion 51. Thus, the external diameter of the shaft portion 51 of the impeller 10 can be made smaller than that in a case where the driven magnets are arranged outside the driving magnets. Hence, according to the present embodiment, it is possible to reduce the size and weight of the impeller 10, and an inertia force regarding the rotation of the impeller 10 can be made small.

If the impeller 10 begins to rotate within the pump casing 60, as shown in FIG. 6, a liquid is suctioned into the pump casing 60 from the suction port 6 of the pump casing 60. The liquid suctioned into the pump casing 60 enters the intra-impeller flow channel Pr within the impeller 10 from the impeller inlet 12.

A portion of the liquid suctioned into the pump casing 60 comes into contact with the front end of the inlet tube portion 21 located on the foremost side in the impeller 10. As mentioned above with respect to FIG. 5, the front end of the inlet tube portion 21 is formed with the circular-arc surface 23 that becomes convex toward the front side. Moreover, the arc radius of the circular-arc surface 23 is 0.2 to 0.3 mm larger than the average radius (3 to 4 μm) of the jelly-like grains contained in the liquid to be carried or the average radius (about 1 to 50 μm) of the microcapsules in the liquid. For this reason, in the present embodiment, the jelly-like grains or the like are not damaged even if the jelly-like grains or the like in the liquid comes into contact with the front end of the inlet tube portion 21.

Additionally, in the present embodiment, as mentioned above, the eyeball diameter de of the impeller 10 is equal to the internal diameter di of the suction port 6 of the pump casing 60. For this reason, in the present embodiment, the pressure loss in the process in which the liquid flows into the intra-impeller flow channel Pr from the suction port 6 of the pump casing 60 can be suppressed, and pump performance can be enhanced. In addition, in the present embodiment, although the eyeball diameter de of the impeller 10 is equal to the internal diameter di of the suction port 6 of the pump casing 60, the same effects as the above can be obtained if the eyeball diameter de of the impeller 10 is equal to or more than the internal diameter di of the suction port 6 of the pump casing 60.

After the liquid that has entered the intra-impeller flow channel Pr receives a centrifugal force from the plurality of rotating blades 11 and flows out of the impeller outlet 13, the liquid is discharged from the discharge port 7 of the pump casing 60.

Figure 7:
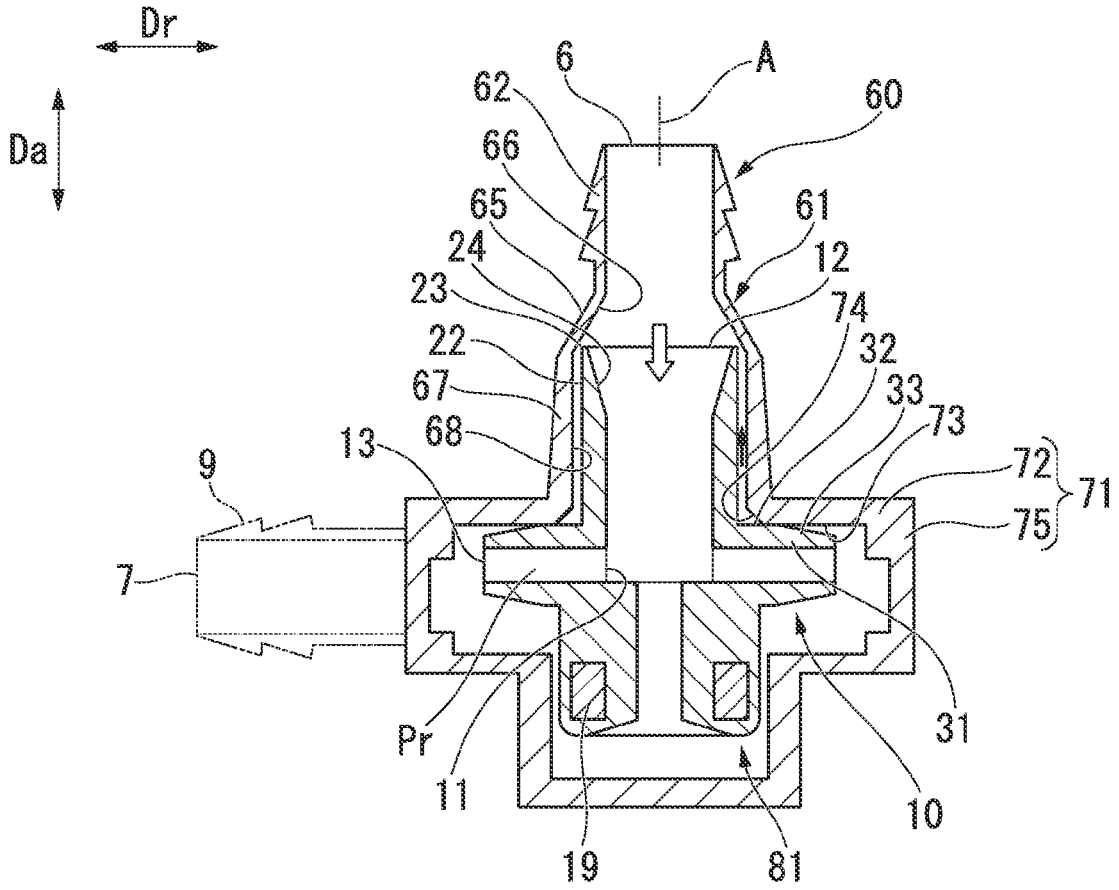
FIG. 7 is a schematic view (a state when a forward thrust force is applied to an impeller) schematically depicting the cross-section of the magnetic coupling pump in the embodiment related to the invention.

A portion of the liquid that has flowed out of the impeller outlet 13, as shown in FIGS. 6 and 7, returns into the enlarged-diameter pipe portion 65 of the pump front casing 61 through between the inner peripheral surface 68 of the front bearing forming portion 67 of the pump front casing 61 and the outer peripheral surfaces 22 of the inlet tube portion 21 of the front shroud 20 from between the inner surface 73 of the front face facing portion 72 of the pump front casing 61 and the front face 32 of the front plate portion 31 of the front shroud 20. Then, the liquid enters the intra-impeller flow channel Pr again from the impeller inlet 12.

Figure 8:
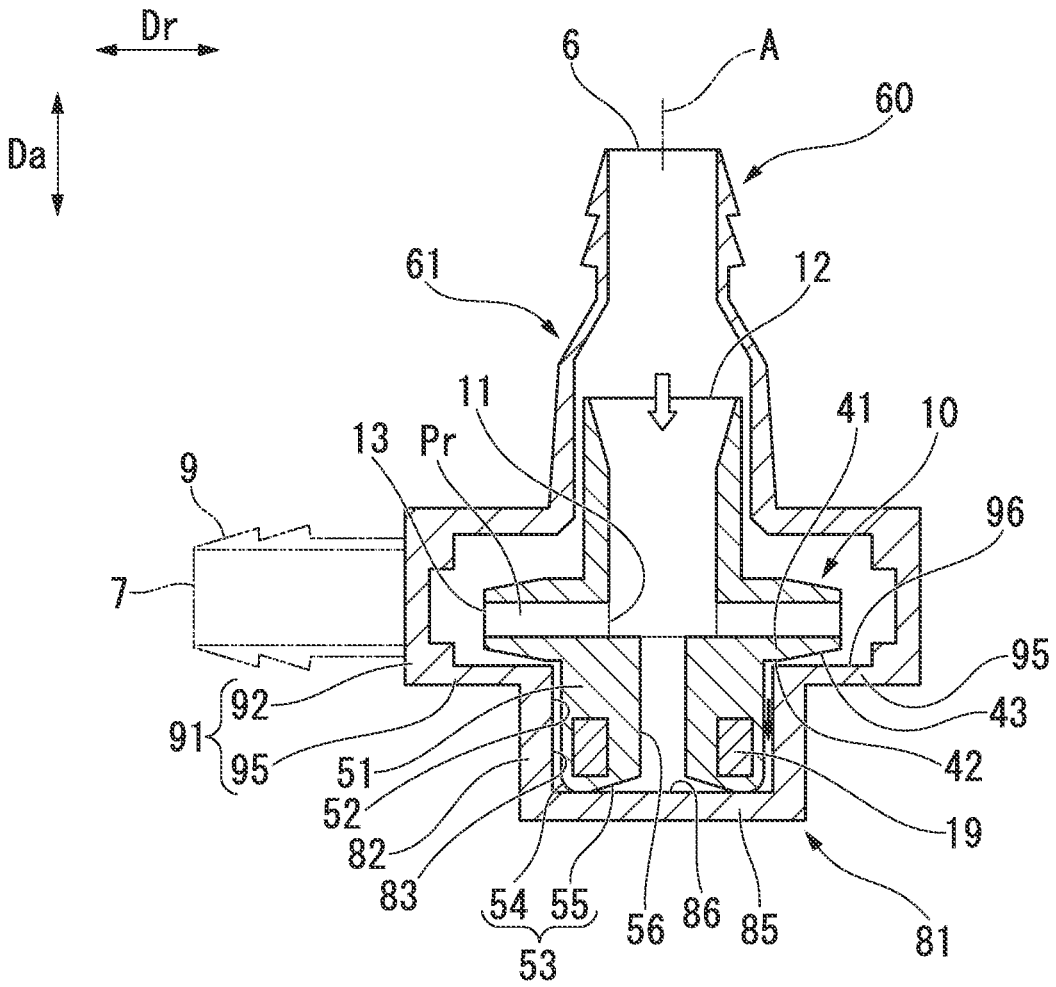
FIG. 8 is a schematic view (a state when a rearward thrust force is applied to the impeller) schematically depicting the cross-section of the magnetic coupling pump in the embodiment related to the invention.

Additionally, the other portion of the liquid that has flowed out of the impeller outlet 13, as shown in FIGS. 6 and 8, returns to the intra-impeller flow channel Pr through between the inner peripheral surface 83 of the rear bearing forming portion 82 of the pump rear casing 81 and the outer peripheral surface 52 of the shaft portion 51 of the rear shroud 40, through between the inner surface 86 of the rear wall plate portion 85 of the pump rear casing 81 and the rear end face 53 of the shaft portion 51 of the rear shroud 40, and through the through hole 56 of the rear shroud 40, from between the inner surface 96 of the rear face facing portion 95 of the pump rear casing 81 and the rear face 42 of the rear plate portion 41 of the rear shroud 40.

A generatrix of the inner peripheral surface 68 of the front bearing forming portion 67 of the pump front casing 61 and a generatrix of the outer peripheral surface 22 of the inlet tube portion 21 of the front shroud 20 are parallel to each other. In other words, the distance between the inner peripheral surface 68 of the front bearing forming portion 67 and the outer peripheral surface 22 of the inlet tube portion 21 is constant in the axis direction Da. Additionally, both the cross-sectional shapes of the inner peripheral surface 68 of the front bearing forming portion 67 of the pump front casing 61 and the outer peripheral surface 22 of the inlet tube portion 21 of the front shroud 20 perpendicular to the rotation axis A are circles. For this reason, the inner peripheral surface 68 of the front bearing forming portion 67 and the outer peripheral surface 22 of the inlet tube portion 21 form dynamic pressure radial bearing faces, respectively, and the liquid that flows between both the faces 68 and 22 functions as a lubrication fluid. Hence, as for the impeller 10, the portion of the inlet tube portion 21 of the impeller 10 is rotatably supported in a non-contact state in the radial direction Dr by the pump casing 60. In addition, when the rotational frequency of the impeller 10 is low, such as at the start of rotation of the impeller 10, a portion of the inner peripheral surface 68 of the front bearing forming portion 67 and a portion of the outer peripheral surface 22 of the inlet tube portion 21 come into contact with each other. If the rotational frequency of the impeller 10 becomes equal to or more than a predetermined rotational frequency, the inlet tube portion 21 floats with respect to the inner peripheral surface 68 of the front bearing forming portion 67 due to the dynamic pressure of a fluid that works between both the faces 68 and 22, and as mentioned above, the inlet tube portion 21 of the impeller 10 is rotatably supported in a non-contact state by the pump casing 60.

Additionally, a generatrix of the inner peripheral surface 83 of the rear bearing forming portion 82 of the pump rear casing 81 and a generatrix of the outer peripheral surface 52 of the shaft portion 51 of the rear shroud 40 are parallel to each other. In other words, the distance between the inner peripheral surface 83 of the rear bearing forming portion 82 and the outer peripheral surface 52 of the shaft portion 51 is constant in the axis direction Da. Additionally, both the cross-sectional shapes of the inner peripheral surface 83 of the rear bearing forming portion 82 of the pump rear casing 81 and the outer peripheral surface 52 of the shaft portion 51 of the rear shroud 40 perpendicular to the rotation axis A are circles. For this reason, the inner peripheral surface 83 of the rear bearing forming portion 82 and the outer peripheral surface 52 of the shaft portion 51 form dynamic pressure radial bearing faces, respectively, and the liquid that flows between both the faces 83 and 52 functions as a lubrication fluid. Hence, as for the impeller 10, the portion of the shaft portion 51 of the impeller 10 is rotatably supported in a non-contact state in the radial direction Dr by the pump casing 60. In addition, as for the shaft portion 51 of the impeller 10, similarly to the inlet tube portion 21, a portion of the inner peripheral surface 83 of the rear bearing forming portion 82 and a portion of the outer peripheral surface 52 of the shaft portion 51 come into contact with each other when the rotational frequency of the impeller 10 is low. If the rotational frequency of the impeller 10 becomes equal to or more than a predetermined rotational frequency, the shaft portion 51 floats with respect to the inner peripheral surface 83 of the rear bearing forming portion 82 due to the dynamic pressure of the fluid that works between both the faces 83 and 52, and the shaft portion 51 of the impeller 10 is rotatably supported in non-contact by the pump casing 60.

As described above, in the present embodiment, two locations of the inlet tube portion 21 and the shaft portion 51 of the impeller 10 are rotatably supported in a non-contact state in the radial direction Dr by the pump casing 60, in other words, the impeller 10 is rotatably supported at both ends in a non-contact state in the radial direction Dr. Moreover, the impeller 10 is supported at two locations of the front side and the rear side on the basis of the position of the center of gravity thereof. Hence, according to the present embodiment, even if moment around an axis perpendicular to the rotation axis A is generated, the impeller 10 can be stably supported.

Additionally, in the present embodiment, the external diameter of the shaft portion 51 of the impeller 10 can be made small as mentioned above. Therefore, the circumferential speed of the shaft portion 51 can be suppressed. Hence, according to the present embodiment, a shearing strain that acts on a liquid that flows between the outer peripheral surface 52 of the shaft portion 51 and the inner peripheral surface 83 of the rear bearing forming portion 82 of the pump rear casing 81 can be made small, and any damage to the jelly-like grains or the like included in this liquid can be suppressed.

In the present embodiment, the position of the impeller 10 in the axis direction Da with respect to the pump casing 60 is held by the magnetic coupling force between the driven magnets 19 within the impeller 10 and the driving magnets 219 of the pump drive unit 200. The position of the impeller 10 in the axis direction Da, which is held by magnetic coupling force, is a position where the impeller surface 10 and the face of the pump casing 60 that face each other in the axis direction Da do not come into contact with each other. That is, in the present embodiment, the impeller 10 is rotatably supported in a non-contact state also in the axis direction Da.

Incidentally, a force in the axis direction Da, that is, a more than expected thrust force may be applied to the impeller 10 due to impact, operation varies, or the like from the outside, and the impeller surface 10 and the face of the pump casing 60 that face each other in the axis direction Da may come into contact with each other.

In the present embodiment, the tapered surface is formed in at least one face out of the impeller surface 10 and the face of the pump casing 60 that faces each other in the axis direction Da so that the distance between the surfaces varies gradually as it goes in the radial direction Dr perpendicular to the axis direction Da. For this reason, even if a thrust force is applied to the impeller 10, and the portion of the impeller 10 and the portion of the pump casing 60 that face each other in the axis direction Da come into contact with each other, a region where face contact is made can be made small, or line contact is made and consequently a region where face contact is made can be eliminated.

In a case where the impeller surface 10 and the face of the pump casing 60 come into face contact with each other, the suction force of the contact portion caused by the negative pressure applied to the contact portion becomes larger as the contacting region becomes larger. Consequently, even if a thrust force is lost, the contact portion continues contacting over a relatively long period of time. In the present embodiment, as mentioned above, even if a portion of the impeller 10 and a portion of the pump casing 60 come into contact with each other, a region where face contact is made is small or is not present. Therefore, the suction force of the contact portion caused by a negative pressure applied to the contact portion can be made small, and if the thrust force is lost and thrust balance is kept, both the portions are spaced apart in a short time, in other words, the impeller 10 returns to its original position in a short time.

That is, in the present embodiment, even if a more than expected thrust force is applied to the impeller 10 due to impact or the like from the outside, and a portion of the impeller 10 and a portion of the pump casing 60 that face each other in the axis direction Da come into contact with each other, a negative pressure applied to between the faces that has contacted can be made small as well as a region where face contact is made is small or is not present.

Specifically, in the present embodiment, as shown in FIG. 7, the front face 32 of the front plate portion 31 of the impeller 10 and the inner surface 73 of the front face facing portion 72 of the pump casing 60 face each other in the axis direction Da.

The front plate tapered surface 33 is formed on the outward side of the front face 32 of the front plate portion 31, and the front case body tapered surface 74 is formed on the inward side of the inner surface 73 of the front face facing portion 72. For this reason, in the present embodiment, even if a forward thrust force is applied to the impeller 10 and the front face 32 of the front plate portion 31 of the impeller 10 and the inner surface 73 of the front face facing portion 72 of the pump casing 60 come into contact with each other, the contact area can be made small.

Additionally, in the present embodiment, the circular-arc surface 23 and the inlet tapered surface 24 that are formed at the front end portion of the inlet tube portion 21 of the impeller 10, and the inner peripheral surface 66 of the enlarged-diameter pipe portion 65 of the pump casing 60 face each other in the axis direction Da. The inlet tapered surface 24 of the impeller 10 inclines to the rear side as it goes to the inward side, and the inner peripheral surface 66 of the enlarged-diameter pipe portion 65 of the pump casing 60 inclines to the front side as it goes to the inward side. For this reason, in the present embodiment, even if a forward thrust force is applied to the impeller 10, both the faces cannot come into face contact with each other. Additionally, in the present embodiment, the minimum interval in the axis direction Da between the circular-arc surface 23 located further toward the front side than the inlet tapered surface 24, in other words, the circular-arc surface 23 located on the foremost side in the impeller 10, and the inner peripheral surface 66 of the enlarged-diameter pipe portion 65 of the pump casing 60 is smaller than the minimum interval in the axis direction Da between the inlet tapered surface 24 of the impeller 10 and the inner peripheral surface 66 of the enlarged-diameter pipe portion 65 of the pump casing 60. For this reason, even if a forward thrust force is applied to the impeller 10 and the impeller 10 moves to the front side, the inlet tapered surface 24 of the impeller 10 and the inner peripheral surface 66 of the enlarged-diameter pipe portion 65 of the pump casing 60 do not come into contact with each other.

Moreover, in the present embodiment, even if the circular-arc surface 23 of the impeller 10 and the inner peripheral surface 66 of the enlarged-diameter pipe portion 65 of the pump casing 60 come into contact with each other, this contact is not face contact but line contact. Therefore, the contact area becomes very small. However, in the present embodiment, when thrust balance is kept, the minimum interval in the axis direction Da between the circular-arc surface 23 of the inlet tube portion 21 of the impeller 10 and the inner peripheral surface 66 of the enlarged-diameter pipe portion 65 of the pump casing 60 is larger than the minimum interval in the axis direction Da between the front face 32 of the front plate portion 31 of the impeller 10 and the inner surface 73 of the front face facing portion 72 of the pump casing 60. Therefore, even if a forward thrust force is applied to the impeller 10 and the impeller 10 moves to the front side, the front face 32 of the front plate portion 31 of the impeller 10 and the inner surface 73 of the front face facing portion 72 of the pump casing 60 come into contact with each other first, and the circular-arc surface 23 of the inlet tube portion 21 of the impeller 10 and the inner peripheral surface 66 of the enlarged-diameter pipe portion 65 of the pump casing 60 do not come into contact with each other. As such, in the present embodiment, even if a forward thrust force is applied to the impeller 10 and the impeller 10 moves to the front side, the circular-arc surface 23 and the inlet tapered surface 24 of the inlet tube portion 21 of the impeller 10 and the inner peripheral surface 66 of the enlarged-diameter pipe portion 65 of the pump casing 60 do not come into contact with each other. However, since one face out of both the faces forms the tapered surface, a negative pressure that acts between both the faces when both the faces approach each other can be made small.

As described above, in the present embodiment, even if a forward thrust force is applied to the impeller 10, the impeller 10 moves to the front side, and the front face 32 of the front plate portion 31 of the impeller 10 and the inner surface 73 of the front face facing portion 72 of the pump casing 60 come into contact with each other, the contact area can be made small, and a negative pressure that acts on the contact portion can be made small. In addition, even if the circular-arc surface 23 and the inlet tapered surface 24 of the inlet tube portion 21 of the impeller 10 and the inner peripheral surface 66 of the enlarged-diameter pipe portion 65 of the pump casing 60 approach each other (non-contact) in that case, a negative pressure that acts between both the faces can be made small. Hence, in the present embodiment, as mentioned above, the impeller 10 can return to its original position in a short time.

Additionally, in the present embodiment, as shown in FIG. 8, the rear end face 53 of the shaft portion 51 of the impeller 10 and the inner surface 86 of the rear wall plate portion 85 of the pump casing 60 face each other in the axis direction Da. In the present embodiment, although the inner surface 86 of the rear wall plate portion 85 of the pump casing 60 is a plane perpendicular to the rotation axis A, the rear end face 53 of the shaft portion 51 of the impeller 10 is formed with the circular-arc surface 54 and the shaft tapered surface 55. For this reason, in the present embodiment, even if a rearward thrust force is applied to the impeller 10, the rear end face 53 of the shaft portion 51 of the impeller 10 and the inner surface 86 of the rear wall plate portion 85 of the pump casing 60 do not come into face contact with each other, but come into line contact with each other.

Additionally, in the present embodiment, the rear face 42 of the rear plate portion 41 of the impeller 10 and the inner surface of the rear face facing portion 95 of the pump casing 60 face each other in the axis direction Da. In the present embodiment, although the inner surface 96 of the rear face facing portion 95 of the pump casing 60 is a plane that widens in the direction perpendicular to the rotation axis A, the rear plate tapered surface 43 is formed on the outward side of the rear face 42 of the rear plate portion 41 of the impeller 10. For this reason, in the present embodiment, even if a rearward thrust force is applied to the impeller 10 and the rear face 42 of the rear plate portion 41 of the impeller 10 and the inner surface 96 of the rear face facing portion 95 of the pump casing 60 come into contact with each other, the contact area can be made small. However, in the present embodiment, even if a rearward thrust force is applied to the impeller 10, the rear face 42 of the rear plate portion 41 of the impeller 10 and the inner surface 96 of the rear face facing portion 95 of the pump casing 60 do not come into contact with each other. This is because, in the present embodiment, the minimum interval in the axis direction Da between the rear face 42 of the rear plate portion 41 of the impeller 10 and the inner surface 96 of the rear face facing portion 95 of the pump casing 60 is larger than the minimum interval in the axis direction Da between the rear end face 53 of the shaft portion 51 of the impeller 10 and the inner surface 86 of the rear wall plate portion 85 of the pump casing 60 when thrust balance is kept, and the rear end face 53 of the shaft portion 51 of the impeller 10 and the inner surface 86 of the rear wall plate portion 85 of the pump casing 60 come into contact with each other when a rearward thrust force is applied to the impeller 10.

In the present embodiment, as mentioned above, the front plate tapered surface 33 of the impeller 10 inclines to the front side as it goes to the inward side, the front case body tapered surface 74 of the pump casing 60 also inclines to the front side as it goes to the inward side. For this reason, in the present embodiment, a flow channel between the front face 32 of the front plate portion 31 of the impeller 10 and the inner surface 73 of the front face facing portion 72 of the pump casing 60 has a shape that easily guides a substance within this flow channel to the front side while directing the substance to the inward side. Hence, in the present embodiment, even if bubbles are mixed in this flow channel, the bubbles can be very smoothly discharged into the enlarged-diameter pipe portion 65 outside this flow channel. In addition, the bubbles that have been discharged to the outside of this flow channel and have reached the enlarged-diameter pipe portion 65 pass through the intra-impeller flow channel Pr, and most thereof are discharged out of the magnetic coupling pump 100 from the discharge port 7.

Additionally, in the present embodiment, the rear plate tapered surface 43 of the impeller 10 inclines to the rear side as it goes to the inward side. For this reason, in the present embodiment, a flow channel between the front face 42 of the rear plate portion 41 of the impeller 10 and the inner surface 96 of the rear face facing portion 95 of the pump casing 60 has a shape that easily guides a substance within this flow channel to the rear side while directing the substance to the inward side. Hence, in the present embodiment, even if bubbles are mixed in this flow channel, the bubbles can be very smoothly discharged to a flow channel between the shaft portion 51 and the pump rear casing 81 outside this flow channel.

Moreover, in the present embodiment, the shaft tapered surface 55 of the impeller 10 inclines to the front side as it goes to the inward side. For this reason, in the present embodiment, a flow channel between the rear end face 53 of the shaft portion 51 of the impeller 10 and the inner surface 86 of the rear wall plate portion 85 of the pump casing 60 has a shape that easily guides substance within this flow channel to the front side while directing the substance to the inward side. Hence, in the present embodiment, even if bubbles are mixed in this flow channel, the bubbles can be very smoothly discharged into the through hole 56 outside this flow channel. In addition, the bubbles discharged to the outside of this flow channel pass through the through hole 56 of the shaft portion 51, flows into the intra-impeller flow channel Pr, and most thereof are discharged out of the magnetic coupling pump 100 from the discharge port 7.

In conclusion, in the present embodiment, as mentioned above, even if a thrust force that is a more than expected force in the axis direction Da is applied to the impeller 10 due to impact, operation varies, or the like from the outside, and a portion of the impeller 10 and a portion of the pump casing 60 that face each other in the axis direction Da come into contact with each other, a region where face contact is made can be made small, or line contact is made and consequently a region where face contact is made can be eliminated, and a negative pressure applied to between the faces that has contacted can be made small. For this reason, in the present embodiment, even if the impeller 10 and the pump casing 60 come into contact with each other, contact time can be shortened, in other words, the impeller 10 can return to its original position in a short time, and reduction in the rotational frequency of the impeller 10 caused by the contact can be suppressed to the minimum. Moreover, in the present embodiment, any damage to a mutual contact portion between the impeller 10 and the pump casing 60 or any damage to the jelly-like grains or the like included in the liquid can be suppressed to the minimum, and seizing in the mutual contact portion between the impeller 10, the pump casing 60 can be prevented.

Additionally, in the present embodiment, the flow channel between the pump casing 60 and the impeller 10 has a shape that easily discharges the bubbles, which have entered between this flow channel, by virtue of the tapered surfaces formed in either of the pump casing 60 and the impeller 10. Therefore, stagnation of the bubbles within this flow channel can be prevented.

INDUSTRIAL APPLICABILITY

In the magnetic coupling pump, reduction in the rotational frequency of the impeller can be suppressed even if thrust balance collapses temporarily.

REFERENCE SIGNS LIST

6: SUCTION PORT
7: DISCHARGE PORT
9: DISCHARGE HOSE CONNECTING PIPE PORTION
10: IMPELLER
11: BLADE
12: IMPELLER INLET
13: IMPELLER OUTLET
19: DRIVEN MAGNET
20: FRONT SHROUD
21: INLET TUBE PORTION
22: OUTER PERIPHERAL SURFACE (OF INLET TUBE PORTION)
23: CIRCULAR-ARC SURFACE
24: INLET TAPERED SURFACE
31: FRONT PLATE PORTION
32: FRONT FACE
33: FRONT PLATE TAPERED SURFACE
40: REAR SHROUD
41: REAR PLATE PORTION
42: REAR FACE
43: REAR PLATE TAPERED SURFACE
51: SHAFT PORTION
52: OUTER PERIPHERAL SURFACE (OF SHAFT PORTION)
53: REAR END FACE (OF SHAFT PORTION)
54: CIRCULAR-ARC SURFACE
55: SHAFT TAPERED SURFACE
56: THROUGH HOLE
60: PUMP CASING
61: PUMP FRONT CASING
62: SUCTION HOSE CONNECTING PIPE PORTION
65: ENLARGED-DIAMETER PIPE PORTION
66: INNER PERIPHERAL SURFACE (OF THE ENLARGED-DIAMETER PIPE PORTION)
67: FRONT BEARING FORMING PORTION
68: INNER PERIPHERAL SURFACE (OF FRONT BEARING FORMING PORTION)
71: FRONT CASING BODY PORTION
72: FRONT FACE FACING PORTION
73: INNER SURFACE (OF FRONT FACE FACING PORTION)
75: FRONT BODY TUBE PORTION
81: PUMP REAR CASING
82: REAR BEARING FORMING PORTION
83: INNER PERIPHERAL SURFACE (OF REAR BEARING FORMING PORTION)
85: REAR WALL PLATE PORTION
91: REAR CASING BODY PORTION
92: REAR BODY TUBE PORTION
95: REAR FACE FACING PORTION
96: INNER SURFACE (OF REAR FACE FACING PORTION)
100: MAGNETIC COUPLING PUMP
200: PUMP DRIVE UNIT
210: MOTOR
211: OUTPUT SHAFT
219: DRIVING MAGNET
220: CUP
230: DRIVE UNIT CASING

The invention claimed is:

1. A magnetic coupling pump comprising:
a closed impeller; and
a casing that houses the closed impeller, wherein
the casing comprises:
a first bearing forming portion configured to support an outer peripheral surface of one end of the closed impeller in an axis direction in a non-contact state with rotation of the closed impeller;
a second bearing forming portion configured to support an outer peripheral surface of another end of the closed impeller in the axis direction in a non-contact state with the rotation of the closed impeller, the axis direction being a direction in which a rotation axis of the closed impeller extends;
a discharge port; and
a suction port on an extension line of the rotation axis, the closed impeller comprises:
a plurality of blades provided in a circumferential direction around the rotation axis;
a front shroud that covers a front side of the plurality of blades that is a suction port side; and
a rear shroud that covers a rear side of the plurality of blades opposite to the suction port,
the front shroud comprises:
an inlet tube portion, which forms a cylindrical shape around the rotation axis and forms an impeller inlet whose front side faces the suction port in the axis direction; and
a front plate portion, which is provided at a rear end of the inlet tube portion and covers the front side of the plurality of blades,
the rear shroud comprises:
a rear plate portion that covers the rear side of the plurality of blades; and
a columnar shaft portion that is centered on the rotation axis and provided at a rear end of the rear plate portion,
an impeller outlet is formed at an outer edge of the closed impeller in a radial direction perpendicular to the axis direction and between the front plate portion and the rear plate portion of the closed impeller,
the columnar shaft portion has a driven magnet formed from a permanent magnet provided within the columnar shaft portion,
a through hole, which penetrates along the rotation axis in the axis direction and connects an interspace between a rear end face of the columnar shaft portion and the casing at a rear side of the magnetic coupling pump to a space between the front plate portion and the rear plate portion, is formed in the columnar shaft portion, the closed impeller is rotatably supported by the first and second bearing forming portions in a non-contact state in the axis direction, and rotatably supported at the inlet tube portion by the first bearing forming portion and at the columnar shaft portion by the second bearing forming portion in a non-contact state in the radial direction, the closed impeller is rotated integrally with the driven magnet by rotation of a driving magnet around the rotation axis, the driving magnet being provided outside of the casing and arranged on an outer peripheral side of the columnar shaft portion so as to face the driven magnet and to be magnetically coupled with the driven magnet, a front plate tapered surface is formed on a front face of the front plate portion of the front shroud, the front plate tapered surface declining toward the front side of the plurality of blades gradually while extending towards an outward side away from the rotation axis, a rear plate tapered surface is formed on a rear face of the rear plate portion of the rear shroud, the rear plate tapered surface inclining toward the rear side of the plurality of blades gradually while extending towards the outward side away from the rotation axis, a shaft tapered surface is formed on the rear end face of the columnar shaft portion, the shaft tapered surface inclining towards a front side of the magnetic coupling pump gradually while extending towards an inward side approaching the rotation axis, an inlet tapered surface is formed on a front end portion of the inlet tube portion, which declines towards the rear side of the magnetic coupling pump while extending towards the inward side approaching the rotation axis from an outer peripheral surface side of the inlet tube portion, and the rear end face of the columnar shaft portion has a circular-arc surface that is continuous with an outer peripheral surface of the columnar shaft portion and the shaft tapered surface, the circular-arc surface having a convex shape in a cross-section of the shaft portion including the rotation axis toward the rear side of the magnetic coupling pump.

2. The magnetic coupling pump according to claim 1, wherein a circular-arc surface is formed connecting to an outer peripheral surface of the inlet tube portion and the inlet tapered surface in a boundary portion between the outer peripheral surface and the inlet tapered surface, the circular-arc surface being in a circular-arc shape in which a shape of a cross-section including the rotation axis is convex toward the front side of the magnetic coupling pump, and an arc radius of the circular-arc surface is larger than an average radius of grains included in a liquid to be carried.

3. The magnetic coupling pump according to claim 1, wherein a minimum internal diameter among internal diameters of the inlet tube portion is equal to or more than an internal diameter of the suction port of the casing.

4. The magnetic coupling pump according to claim 1, wherein the second bearing forming portion has a cylindrical shape around the rotation axis and faces an outer peripheral surface of the columnar shaft portion at a distance therefrom to form a dynamic pressure bearing face for the columnar shaft portion.

5. The magnetic coupling pump according to claim 1, wherein the first bearing forming portion has a cylindrical shape around the rotation axis and faces an outer peripheral surface of the inlet tube portion at a distance therefrom to form a dynamic pressure bearing face for the inlet tube portion.

6. A magnetic coupling pump unit comprising:

the magnetic coupling pump according to claim 1;

a motor having a rotating output shaft;

the driving magnet fixed to the output shaft of the motor; and a drive unit casing that houses the motor and the driving magnet, and to which the magnetic coupling pump is detachably attached so that the rotation axis of the magnetic coupling pump is located on an extension line of the output shaft of the motor.

7. The magnetic coupling pump according to claim 3, wherein the second bearing forming portion has a cylindrical shape around the rotation axis and faces an outer peripheral surface of the columnar shaft portion at a distance therefrom to form a dynamic pressure bearing face for the columnar shaft portion.

8. The magnetic coupling pump according to claim 3, wherein the first bearing forming portion has a cylindrical shape around the rotation axis and faces an outer peripheral surface of the inlet tube portion at a distance therefrom to form a dynamic pressure bearing face for the inlet tube portion.

9. A magnetic coupling pump unit comprising:

the magnetic coupling pump according to claim 3;

a motor having a rotating output shaft;

the driving magnet fixed to the output shaft of the motor; and a drive unit casing that houses the motor and the driving magnet, and to which the magnetic coupling pump is detachably attached so that the rotation axis of the magnetic coupling pump is located on an extension line of the output shaft of the motor.

10. The magnetic coupling pump according to claim 2, wherein a minimum internal diameter among internal diameters of the inlet tube portion is equal to or more than an internal diameter of the suction port of the casing.

11. The magnetic coupling pump according to claim 2, wherein the second bearing forming portion has a cylindrical shape around the rotation axis and faces an outer peripheral surface of the columnar shaft portion at a distance therefrom to form a dynamic pressure bearing face for the columnar shaft portion.

12. The magnetic coupling pump according to claim 1, wherein the front plate tapered surface is formed on an outer edge of the front shroud in the radial direction, and the rear plate tapered surface is formed on an outer edge of the rear plate portion of the rear shroud in the radial direction.

* * * * *